US005593047A

United States Patent [19]

Haugen

[11] Patent Number: 5,593,047

[45] Date of Patent: Jan. 14, 1997

[54] DISPLAY ASSEMBLY

[75] Inventor: Larry C. Haugen, Racine, Wis.

[73] Assignee: Great Northern Corporation, Racine, Wis.

[21] Appl. No.: 330,318

[22] Filed: Oct. 27, 1994

[51] Int. Cl.[6] ..... A47F 5/10

[52] U.S. Cl. ..... 211/58; 211/163; 403/286

[58] Field of Search ..... 211/58, 56, 50, 211/55, 106, 175, 163; 403/286, 65, 62, 53

[56] References Cited

U.S. PATENT DOCUMENTS

| | | | |
|---|---|---|---|
| 923,647 | 1/1909 | Gullong | 211/50 |
| 3,223,247 | 12/1965 | Bleed | 211/58 |
| 3,931,894 | 1/1976 | Murphy | 211/177 |
| 4,003,471 | 1/1977 | Alfano | 211/56 |
| 4,102,069 | 7/1978 | Eckert | 211/58 |
| 4,282,976 | 8/1981 | Fitzgerald | 211/59.1 |
| 4,381,616 | 5/1983 | Saxer | 40/502 |
| 4,412,621 | 11/1983 | Eichner | 211/58 |
| 4,610,560 | 9/1986 | Miller | 403/119 |
| 4,738,038 | 4/1988 | Tanne et al. | 40/10 |
| 4,946,050 | 8/1990 | Akopiantz | 211/182 |
| 4,991,726 | 2/1991 | Johnson | 211/189 |
| 5,012,937 | 5/1991 | Owens | 211/189 |
| 5,025,931 | 6/1991 | Berger | 211/13 |
| 5,046,274 | 9/1991 | David | 40/604 |
| 5,195,642 | 3/1993 | Dardashti | 211/41 |
| 5,224,611 | 7/1993 | Phillipson et al. | 211/168 |

*Primary Examiner*—Leslie A. Braun
*Assistant Examiner*—Willie W. Berry, Jr.
*Attorney, Agent, or Firm*—Andrus, Sceales, Starke & Sawall

[57] ABSTRACT

A display assembly is provided which includes one or more display stands, each having a T-shaped base and one or more tower members extending therefrom. Each tower member is rotatable about a rod which extends into the T-shaped base. A connector plate is used to interconnect two or more display stands in order for the interconnected display stand to assume many different configurations. One or more display racks are connected to each tower member. Each display racks accommodates products having different widths.

12 Claims, 4 Drawing Sheets

FIG. 5
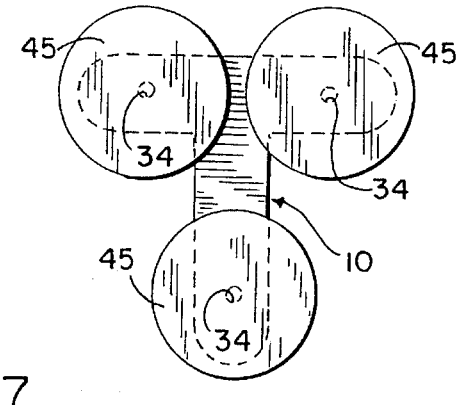
FIG. 6
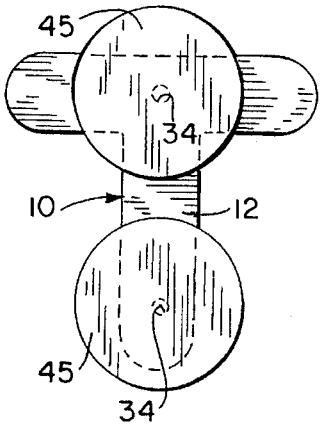
FIG. 7
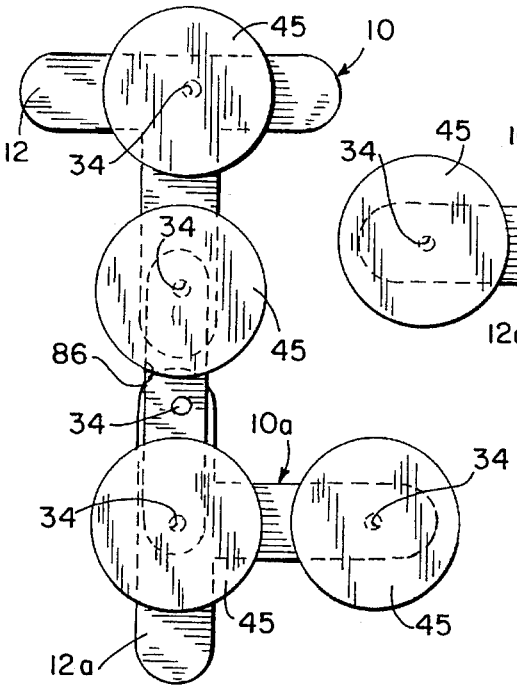
FIG. 8
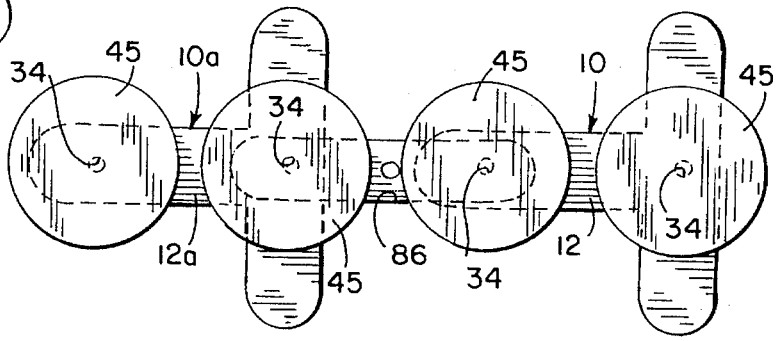
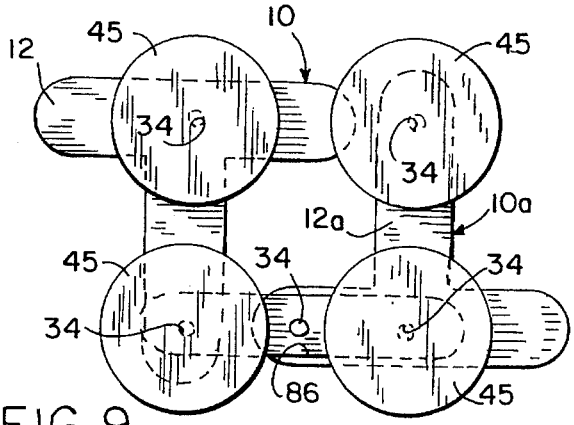
FIG. 9
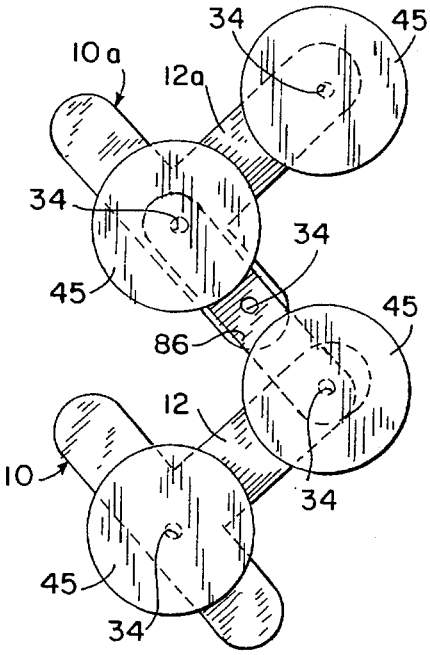
FIG. 10

FIG. 11
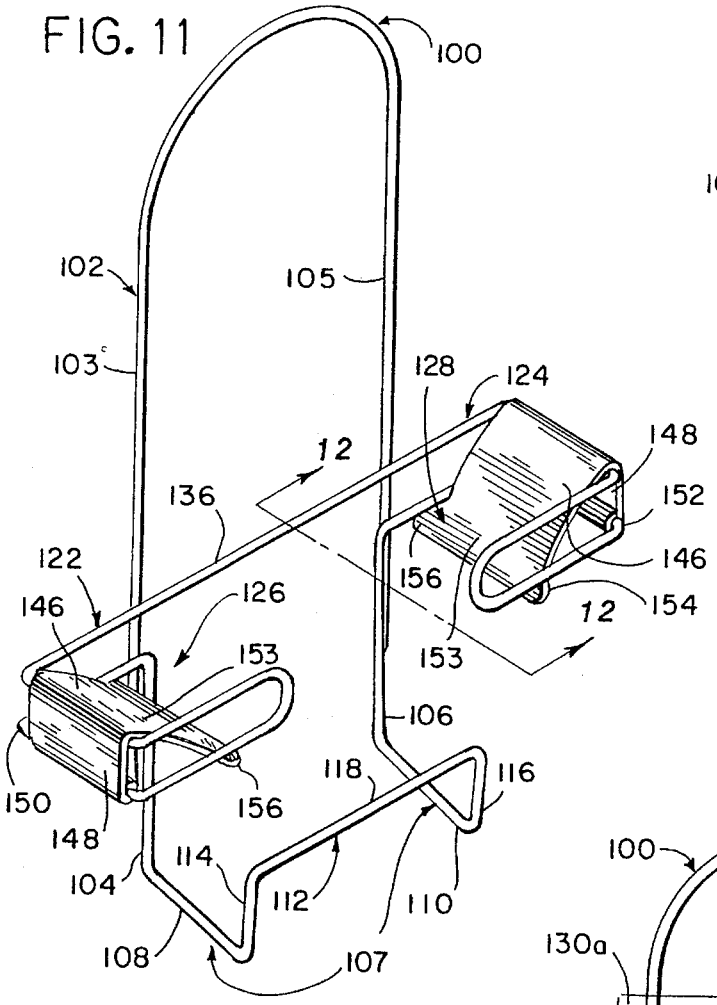
FIG. 12
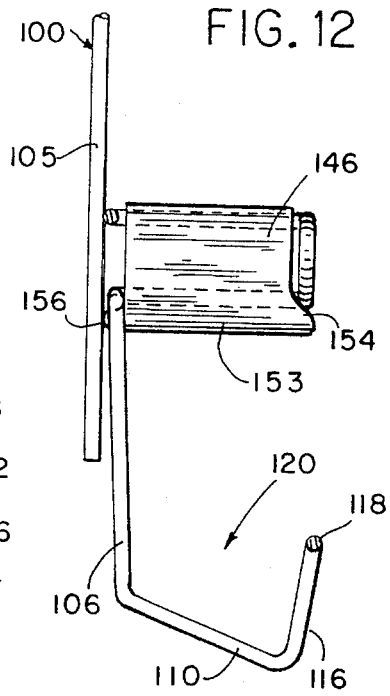
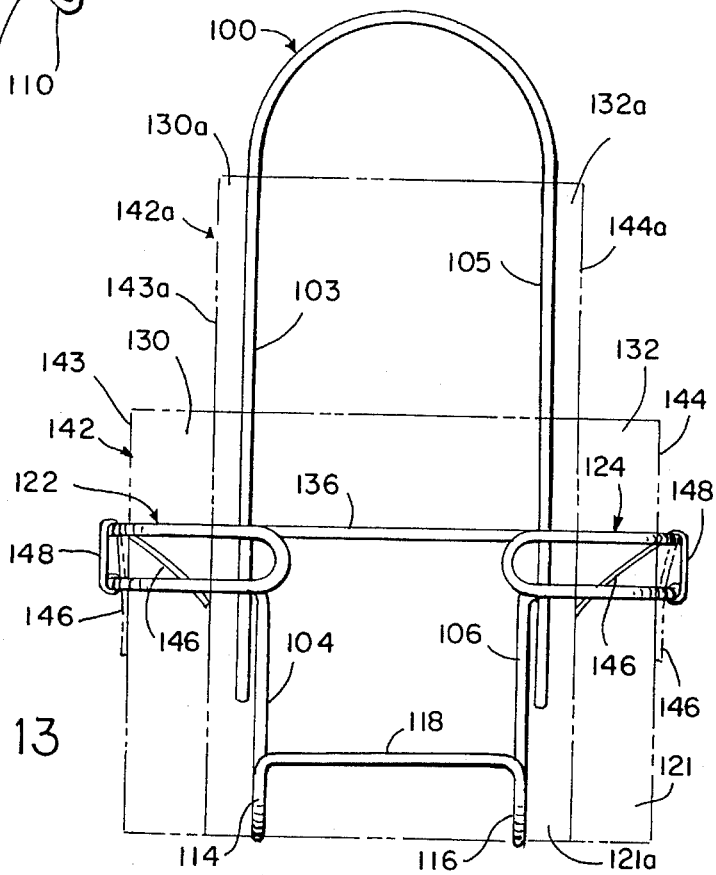
FIG. 13

DISPLAY ASSEMBLY

BACKGROUND AND SUMMARY OF THE INVENTION

This invention relates to displays, in particular, to a modular display assembly.

Many products, such as greeting cards, magazines, and the like, are displayed to potential customers on a display rack attached to a display stand. In order to accommodate the different products, display racks and display stands take on many different styles, sizes and configurations. It is highly desirable for each display rack to accommodate many different styles and sizes of products for maximum utilization of the display stand.

In addition, the floor space available for a display stand is dependent upon the retail establishment where the display stand is located. Consequently, it is highly desirable to provide a display stand which is capable of displaying numerous types of products, and which may be manipulated into different configurations depending on the floor space available in a retail establishment.

Therefore, it is a primary object and feature of the present invention to provide a display assembly which may be used to display many types of different products.

It is a further object and feature of the present invention, to provide a display assembly which assumes many different configurations depending on the floor space available.

It is a further object and feature of the present invention to provide the display assembly which is simple to assemble by the end user.

A display assembly is provided having a plurality of interconnected display stands. Each display stand includes a T-shaped base having an upper surface lying in a horizontal plane, and a plurality of rod receiving openings extending therein.

Each display stand also includes one or more rods having a first end extending into a distinct rod receiving opening in the T-shaped base, and a second, opposite end. A rotatable tower member is positioned about each rod between the first and the second ends of the rods. An end cap is placed over the second end of the rod so as to sandwich the tower member between the end cap and the base.

A connector plate is provided for interconnecting a pair of display stands. The connector plate has first and second sides interconnected by one or more edges, and a plurality of apertures extending therethrough. One side of the connector plate includes a plurality of spaced ribs extending radially from a pair of the apertures.

The T-shaped base also includes a plurality of rib receiving grooves extending radially along the upper surface of the T-shaped base from one or more of the rod receiving openings. In order to interconnect the pair of display stands with the connector plate, an aperture extending through the connector plate is placed over a rod receiving opening in each of the display stand bases to be interconnected, such that each rib meshes with a corresponding groove along the upper surface of the T-shaped base. The connector plate is then secured to each display stand.

A display rack is provided for holding one or more products for display on the display stand. The display rack includes a support structure mounted to the tower member of the display stand. The support structure, in combination with a base and a stop, form a product receiving trough for receiving a first end of each of the products to be held by the display rack.

First and second opposing, parallel side members extend from opposite sides of the support structure for receiving the products to be displayed therebetween. An alignment member extends from each side member toward the opposing side member so as to align the edges of the products to be displayed.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 5 is a top plan view showing a first configuration of the display stand of FIG. 1;

FIG. 6 is a top plan view showing a second configuration of the display stand of FIG. 1;

FIG. 7 is a top plan view showing a first configuration of the pair of interconnected display stands of FIG. 2;

FIG. 8 is a top plan view showing a second configuration of the pair of interconnected display stands of FIG. 2;

FIG. 9 is a top plan view showing a third configuration of the pair of interconnected display stands of FIG. 2;

FIG. 10 is a top plan view showing a fourth configuration of the pair of interconnected display stands of FIG. 2;

FIG. 11 is an isometric view of a display rack for use with the display stand of FIG. 1;

FIG. 12 is a sectional view of the display rack of FIG. 11 taken along line 12—12; and FIG. 13 is a front elevational view of the display rack of the FIG. 11 holding various sized display items, shown in phantom.

DESCRIPTION OF THE ILLUSTRATED EMBODIMENT

Figure 1:
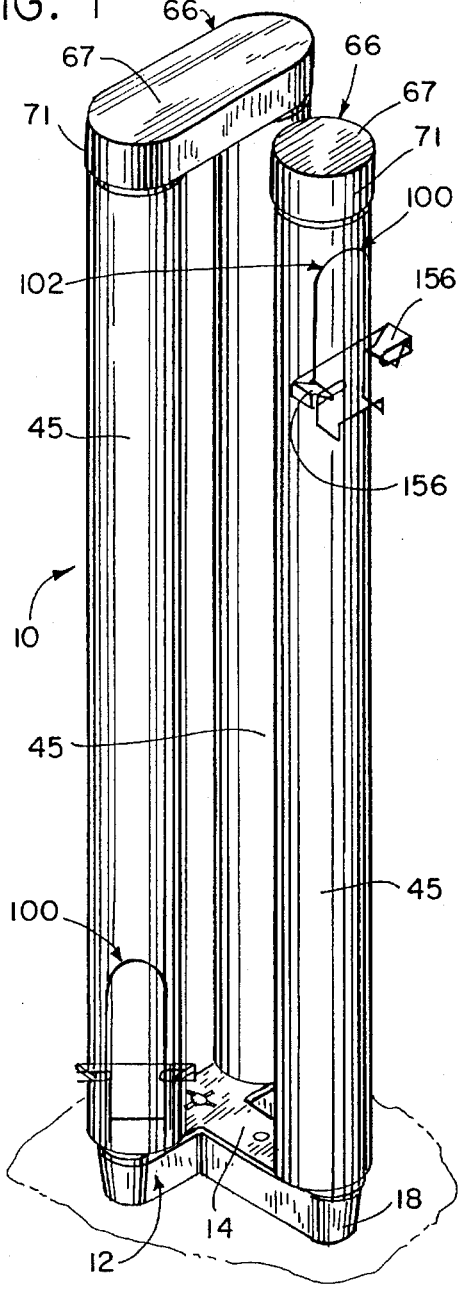
FIG. 1 is an isometric view of the display stand of the present invention.

A display stand corresponding to the present invention is generally designated by the reference numeral 10. Display stand 10 includes a generally T-shaped base 12 having a T-shaped upper wall 14 and a T-shaped bottom wall 16 interconnected by a T-shaped side wall 18.

Figure 3:
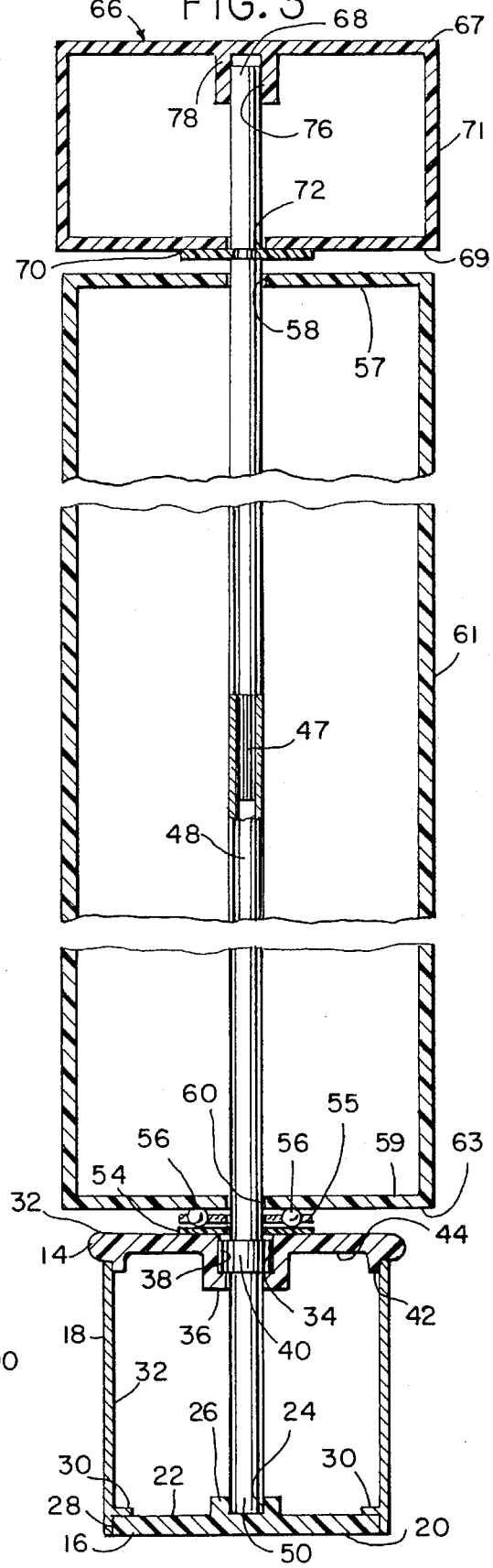
FIG. 3 is a longitudinal sectional view of one tower of the display stand of FIG. 1.

Referring to FIG. 3, bottom wall 16 includes a lower surface 20 whereon T-shaped base 12 rests on a floor, table or the like. A ring shaped rib 26 extends vertically from the upper surface 22 of bottom portion 16 so as to form a rod receiving slot 24 therein. T-shaped side wall 18 surrounds the outer periphery 28 of bottom wall 16 and includes a flange 30 projecting laterally from sidewall 31 of side wall 18 toward the interior of T-shaped base 12. Flange 30 facilitates the interconnecting of side wall 18 to bottom wall 16 with an adhesive or the like.

Top wall 14 of T-shaped base 12 has an upper surface 32 extending laterally along a horizontal plane. The upper surface 32 includes a bearing receipt opening 34 extending therethrough which is defined by a circular inner surface 38. A rib 36 extends along the base of inner surface 38 of bearing receipt opening 34 in order to support a bearing 40, as hereinafter described.

A projection 42 depends from the bottom surface 44 of upper wall 14. Projection 42 is received within the side wall 18 of T-shaped base 12 in order to prevent lateral movement of upper portion 14 along the horizontal plane.

In order to rotatably mount a tubular tower member 45 to T-shaped base 12, a narrowed end portion 47 of a rod 46 is inserted within a sleeve 48, and rod 46 and sleeve 48 are slid into T-shaped base 12 through bearing receipt opening 34 such that an end 50 of sleeve 48 is received within rod receiving slot 24. As sleeve 48 is inserted into bearing receipt opening 34, a portion of sleeve 48 is received within rib 36 extending from inner surface 38 of bearing receipt opening 34 thereby preventing horizontal movement of rod 46.

In order to facilitate rotation of tower member 45 about rod 46 and sleeve 48, bearing 40 is placed about sleeve 48 and positioned within the bearing receipt opening 34 in the upper portion 14 of T-shaped base 12. The upper surface of rib 36 prevents bearing 40 from sliding into the interior of T-shaped base 12. A washer 54 is placed about sleeve 48, and rests on the upper surface 32 of the upper portion 14 of T-shaped base 12. A bearing washer 55 is placed over sleeve 48 between washer 54 and tower member 45. Bearing washer 55 includes a plurality of bearings 56 to facilitate rotation of tower member 45 about sleeve 48.

Tower member 45 is generally cylindrical in shape, and includes upper 57 and lower 59 flat, disc shaped end portions which are interconnected by a cylindrical sidewall 61. Upper and lower end portions 57 and 59 each include an opening 58 and 60, respectively, which are dimensioned for receipt of rod 46 and sleeve 48, respectively, therethrough. Tower member 45 is placed over rod 46 and sleeve 48 such that sleeve 48 extends through openings 58 and 60. When positioned, lower surface 63 of disc shaped end portion 59 rides on the bearings 56 in bearing washer 55. This, in turn, allows tower member 45 to rotate about sleeve 48. As seen in FIGS. 5–6, display stand 10 may utilize two or three rotatable tower members 45 depending on the needs and desires of the end user.

An end cap 66 is placed over an upper end 68 of sleeve 48. Each end cap 66 includes an upper portion 67 and a lower portion 69 interconnected by a side portion 71. End cap 66 further includes one or more openings 72 in bottom portion 69 for receiving second end 68 of each distinct sleeve 48. End 68 of each sleeve 48 extends into a distinct rod receiving slot 76 in end cap 66 which is formed by a rib 78 depending from the upper portion 67 of end cap 66. Rib 78, in combination with opening 72, prevents lateral movement of end cap 66 when positioned on end 68 of sleeve 48. As best seen in FIG. 3, when end cap 66 is positioned over end 68 of sleeve 48, washer 70 supports the end cap and spaces the end cap above tower member 45.

Figure 4:
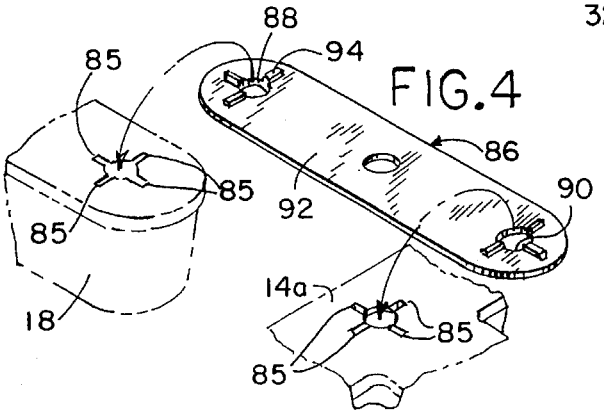
FIG. 4 is an exploded isometric view of a portions of the bases of the interconnected display stands of FIG. 2.
Figure 2:
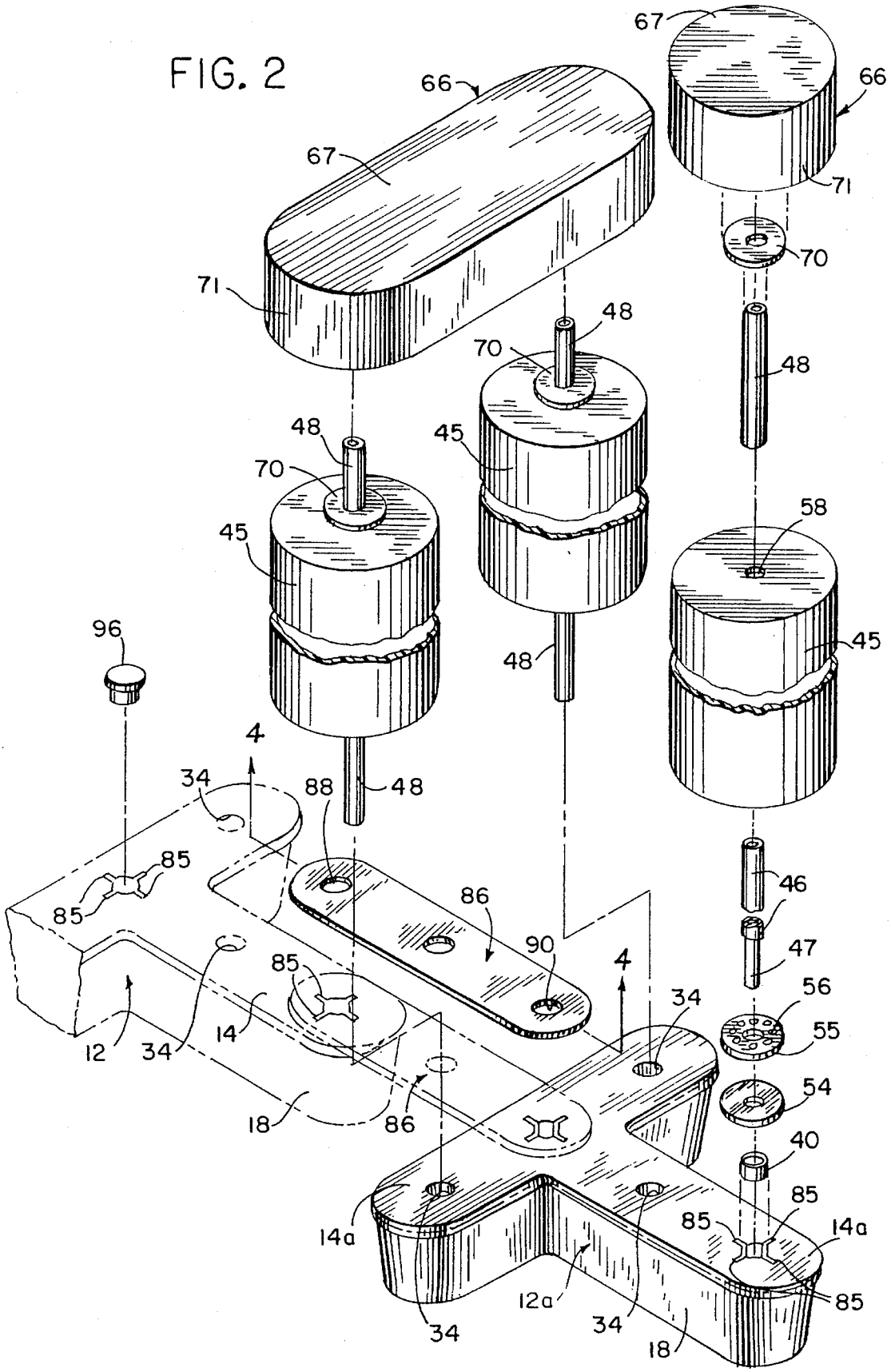
FIG. 2 is an exploded isometric view of a pair of interconnected display stands.

Referring to FIGS. 2, 4, in order to interconnect a pair of display stands, a plate or connector 86 is used. To facilitate understanding, a pair of display stands are shown in FIGS. 2, 4, and generally designated by the reference numerals 10 and 10*a*.

Each display stand 10, 10*a* includes a T-shaped base 12, 12*a* having a T-shaped upper wall 14, 14*a*, respectively. Each upper wall 14 and 14*a* has an upper surface 32 extending laterally along a horizontal plane which includes a plurality of bearing receipt openings 34 extending therethrough. A plurality of grooves 85 extend along upper surface 32 radially from one or more of the bearing receipt openings 34.

Connector 86 includes a pair of opposing apertures 88 and 90, the diameter of which is generally equal to the diameter of each bearing receipt opening 34, and slightly larger than the diameter of sleeve 48. The underside 92 of connector 86 includes a plurality of ribs 94 extending radially from each aperture 88 and 90. As best seen in FIG. 4, ribs 94 are spaced so that each rib 94 may be received in a distinct groove 85 extending radially from bearing receipt opening 34 in the upper wall 14 and 14*a* of each T-shaped base 12 and 12*a*, respectively, when the underside 92 of connector 86 abuts the upper surface 32 of each T-shaped base 12 and 12*a*.

In order to secure connector 86 to a display stand 10 and 10*a*, connector 86 may be substituted for washer 54 when assembling display stand 10 and 10*b*, as previously described. When connector 86 is positioned between upper surface 32 of upper wall 14*a*, 14*b* of T-shaped base 12, 12*a*, respectively, and bearing washer 55, sleeve 48 may be extended through a distinct aperture 88 or 90 in connector 86 and into T-shaped base 12 or 12*a*, respectively. In the alternative, a plug 96, FIG. 2, may be inserted through a distinct aperture 88 or 90 into bearing receipt opening 34 so as to maintain each rib 94 in a predetermined groove 85 and secure connector 86 to display stand 10, 10*a*.

When interconnected, each T-shaped base 12 and 12*a* is rotatable between distinct positions dictated by slots 85 and ribs 94 about a vertical axis extending through the center point of aperture 88 and 90, and perpendicular to the horizontal plane. As seen in FIGS. 7–10, each T-shaped base 12 and 12*a* may be manipulated in order to form many different configurations for the display assembly of the present invention. In each configuration, each rib 94 on the first side 92 of connector 86 is received in a distinct, predetermined groove 85 extending along upper surface 32 on T-shaped base 12, 12*a*. As previously described, connector 86 may then be secured to each display stand 10, 10*a* in order to maintain each rib 94 in the predetermined groove 85, and to prevent accidental rotation of each T-shaped base 12 and 12*a* about the vertical axis.

In order to display products with the display stand 10, 10*a* of the present invention, a display rack may be used. One such display rack is shown in FIGS. 11–13 and generally designated by the reference numeral 100. Display rack 100 includes a rear support structure 102 which extends along a longitudinal axis and has first 103 and second 105 parallel legs. A pair of bottom supports 104 and 106 depend below legs 103 and 105, respectively.

A base 107 is defined by a first rod 108 extending from bottom support 104, and a second rod 110 extending from bottom support 106. A stop 112 includes a first leg 114, extending from rod 108, and a second leg 116, extending from rod 110, interconnected by a cross bar 118 such that the stop 112, rods 108 and 110, and bottom supports 104 and 106 form a trough 120 for receiving a first end 121, 121*a* of each display product 142, 142*a*, respectively, therein, FIG. 13.

Display rack 100 further includes a pair of generally U-shaped side support structures 122 and 124 extending from opposite sides of support structure 102. Each side support structure 122 and 124 includes a product receiving area 126 and 128 respectively, for receiving opposite sides 130, 132 or 130*a*, 132*a* of the products 142 or 142*a*, respectively, to be displayed. A cross bar 136 interconnects side support structures 122 and 124 to legs 103 and 105 of support structure 102 in order to prevent the product 142, 142*a* to be displayed from falling out of the display rack 100.

In order to align the opposing edges 143, 144 or 143*a*, 144*a* of the products 142 or 142*a*, respectively, to be displayed, a means for aligning edges of the product to be displayed is provided. The means for aligning the edges includes a flap 146 having a first end 148 interconnected to the base 150 and 152 of each side support structure 122 and 124, respectively. Flap 146 has a width slightly smaller than the width of the product receiving area 126 and 128 in each side support structure 122 and 124, respectively. The second end 153 of each flap 146 includes a pair of projections 154 and 156 which extend outward from second end 153 of flap 146. The second end 153 of flap 146 has a width greater than the width of product receiving areas 126 and 128 in side support structures 122 and 124, respectively. the width of product receiving areas 126 and 128 in side support structures 122 and 124, respectively.

As best seen in FIG. 11, each second end 153 of flap 146 is biased toward the base 150 and 152 of opposite side support structures 122 and 124, respectively. Referring to FIG. 13, the bias of each flap 146 allows display rack 100 to accommodate products 142 of a first predetermined width and align the edges 143 and 144 thereon, or replace the first product 142 with a second product 142*a* of different width, and align the edges 143*a* and 144*a* thereon. This, in turn, dramatically increases the number of products which may be displayed on display stand 10, 10*a*.

Various alternate embodiments of carrying out the invention are contemplated as being within the scope of the following claims, particularly and distinctly claiming the subject matter regarded as the invention.

I claim:

1. A display assembly, comprising:

a plurality of display stands, each display stand comprising:

a T-shaped base having an upper surface lying in a horizontal plane and a plurality of rod receiving openings therein, the upper surface of the T-shaped base includes a plurality of spaced grooves radially extending from one or more rod receiving openings;

one or more rods extending perpendicular to the horizontal plane, each rod having a first end extending into a distinct rod receiving opening in the T-shaped base and a second, opposite end;

one or more tower members, each tower member positioned about a distinct rod between the first and second ends; and one or more end caps, each end cap having a lower surface lying in a second horizontal plane parallel to the first horizontal plane, and one or more rod receiving openings therein for receiving the second end of a distinct rod such that each tower member is positioned between the respective end cap and the T-shaped base;

a connector plate for interconnecting a pair of the plurality of the display stands; and one or more display racks interconnected to each tower member for receiving and displaying one or more products, each display rack including an alignment member for aligning each of the one or more products received within the display rack.

2. The display assembly of claim 1 wherein the connector plate includes first and second sides interconnected by one or more edges, and a plurality of apertures therein, a first side of the connector plate having a plurality of spaced ribs extending radially from each aperture, and a means for securing the connector plate to each display stand such that a first of the plurality of apertures in the connector plate is aligned with a distinct rod receiving opening in one of the pair of interconnected display stands and a second of the plurality of apertures in the connector plate is aligned with a distinct rod receiving opening in the other of the pair of interconnected display stands.

3. The display assembly of claim 2 wherein each rib extending radially from the first of the plurality of apertures in the connector plate is received within a distinct groove in the upper surface of the T-shaped base in one of the pair of interconnected display stands, and each rib extending radially from the second of the plurality of apertures in the connector plate is received within a distinct groove in the upper surface of the T-shaped base in the other of the pair of interconnected display stands.

4. The display assembly of claim 3 wherein each display stand is rotatable about an axis perpendicular to the horizontal plane and extending through the center of the aperture aligned with the distinct rod receiving opening in the respective display stand.

5. A display assembly, comprising:

a first and second display stand, each display stand comprising:

a T-shaped base having an upper surface lying in a horizontal plane and a plurality of rod receiving openings therein;

one or more rods extending perpendicular to the horizontal plane, each rod having a first end extending into a distinct rod receiving opening in the T-shaped base and a second, opposite end;

one or more tower members, each tower member positioned about a distinct rod between the first and second ends; and one or more end caps, each end cap having a lower surface lying in a second horizontal plane parallel to the first horizontal plane, and one or more rod receiving openings therein for receiving the second end of a distinct rod such that each tower member is positioned between the respective end cap and the T-shaped base;

a connector plate for interconnecting a pair of the plurality of the display stands; and one or more display racks interconnected to each tower member for receiving and displaying one or more products, each display rack including a trough for receiving a first end each of the one or more products to be received and opposing first and second edges of each of the one or more products so as to align the first opposing edges of the one or more products received in the trough and align the second opposing edges of the one or more products received in the trough, the trough of the display each defined by:

a support structure extending along a longitudinal axis;

a base connected to the first end of the support structure; and a stop connected to the base wherein the stop, the base, and the support structure define the trough;

first and second opposing side members extending parallel from opposite sides of the support structure for receiving the one or more members therebetween;

first and second flaps, each flap interconnected to a distinct side member of the display rack and is biased toward the opposing side member of the display rack.

6. A display assembly, comprising:

first and second display stands, each display stand comprising:

a generally T-shaped base having an upper surface lying in a horizontal plane and a plurality of rod receiving openings therein;

one or more rods extending perpendicular to the horizontal plane, each rod having a first end extending into a distinct rod receiving opening in the T-shaped base and a second, opposite end; and one or more tower members, each tower member positioned about a distinct rod between the first and second ends for rotational movement thereabout; and a connector plate for interconnecting each of the T-shaped bases such that the T-shaped bases are permitted to pivot with respect to one another to allow the display assembly to form one of a plurality of distinct, predetermined configurations.

7. The display assembly of claim 6 wherein each display stand includes one or more end caps, each end cap having a lower surface lying in a second horizontal plane parallel to the first horizontal plane, and one or more rod receiving openings therein for receiving the second end of a distinct rod such that each tower member is positioned between the respective end cap and a T-shaped base.

8. The display assembly of claim 6 further comprising one or more display racks interconnected to each tower member for receiving and displaying one or more products, each display rack including alignment member for aligning each of the one or more products received within the display rack.

9. The display assembly of claim 8 wherein each display rack includes a trough for receiving a first end each of the one or more products to be received and displayed, and a product alignment member for engaging opposing first and second edges of each of the one or more products so as to align the first opposing edges of the one or more products received in the trough and align the second opposing edges of the one or more products in the trough.

10. The display assembly of claim 9 wherein the trough of the display rack is defined by:

a support structure extending along a longitudinal axis;

a base connected to the first end of the support structure; and a stop connected to the base where in the stop, the base, and the support structure define the trough.

11. The display assembly of claim 10 further comprising first and second opposing side members extending parallel from opposite sides of the support structure for receiving the one or more products therebetween.

12. A method of interconnecting first and second display stands, each display stand including a base having an upper surface lying in a horizontal plane and a plurality of rod receiving openings therein, the upper surface including a plurality of spaced grooves radially extending from one or more rod receiving openings, comprising the steps of:

providing a connector plate having first and second sides interconnected by one or more edges, and having first and second apertures therein, the first side of the connector plate including a plurality of ribs extending radially from each aperture;

abutting a portion of the first side of the connector plate against the upper surface of the base of the first display stand such that the first aperture in the connector plate is aligned with a distinct rod receiving opening, and each rib is received within a distinct groove;

abutting a portion of the first side of a connector plate against the upper surface of the base of the second display stand such that the second aperture in the connector plate is aligned with a distinct rod receiving opening, and each rib is received within the distinct groove; and securing the connector plate to each display stand such that each rib is maintained within the respective groove.

* * * * *